US012404735B2

(12) United States Patent
Akhare

(10) Patent No.: US 12,404,735 B2
(45) Date of Patent: Sep. 2, 2025

(54) FORGED BOP INTERNAL CAVITY PROFILE FOR WORKOVER RIGS

(71) Applicant: WORLDWIDE OILFIELD MACHINE, INC., Houston, TX (US)

(72) Inventor: Prashant N Akhare, Cypress, TX (US)

( * ) Notice: Subject to any disclaimer, the term of this patent is extended or adjusted under 35 U.S.C. 154(b) by 81 days.

(21) Appl. No.: 18/349,405

(22) Filed: Jul. 10, 2023

(65) Prior Publication Data

US 2024/0110455 A1 Apr. 4, 2024

Related U.S. Application Data

(60) Provisional application No. 63/412,311, filed on Sep. 30, 2022.

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 33/063; E21B 33/061
USPC ..... 251/1.3, 1.1
See application file for complete search history.

(56) References Cited

U.S. PATENT DOCUMENTS 2,194,255 A * 3/1940 Allen ..... E21B 33/062 251/1.3
3,360,233 A * 12/1967 Allen ..... E21B 33/062 251/1.3
3,871,613 A * 3/1975 LeRouax ..... E21B 33/062 251/1.3
3,904,212 A * 9/1975 Pugh ..... E21B 33/062 251/1.3
4,044,988 A * 8/1977 Arzumanov ..... E21B 33/062 251/1.3
4,305,565 A * 12/1981 Abbe ..... E21B 33/062 92/24
4,325,534 A * 4/1982 Roark ..... E21B 33/062 251/59
4,488,703 A * 12/1984 Jones ..... E21B 33/062 251/1.3
4,519,571 A * 5/1985 Jones ..... E21B 33/062 92/24
4,519,575 A * 5/1985 Akkerman ..... F16K 31/1228 92/52
4,526,339 A * 7/1985 Miller ..... E21B 33/062 251/366
4,541,606 A * 9/1985 Williams, Jr. ..... E21B 33/062 251/1.3
4,558,842 A * 12/1985 Peil ..... E21B 33/062 285/305
4,638,972 A * 1/1987 Jones ..... E21B 33/062 251/1.3

(Continued)

*Primary Examiner* — Daphne M Barry
(74) *Attorney, Agent, or Firm* — Kenneth L. Nash; Thomas D. Nash

(57) ABSTRACT

A machined internal cavity for a forged block of a workover BOP. The ram internal cavity has a bore along an inner cavity wall into which a ram guide is insertable. The ram cavity has a flat upper sealing surface that is engageable with a seal on a ram and a raised landing surface to guide the ram to engage the seal with the flat upper sealing surface. Mud slots are machined on the lower surface of the machined internal cavity profile. The ram has a side entry access point into which the rams are installed or accessed within the machined internal cavity.

19 Claims, 10 Drawing Sheets

(56) References Cited

U.S. PATENT DOCUMENTS

| | | | | |
|---|---|---|---|---|
| 9,121,246 | B2 * | 9/2015 | Foote | E21B 33/062 |
| 10,989,010 | B2 * | 4/2021 | Ellison | E21B 33/063 |
| 2021/0062606 | A1 * | 3/2021 | Moya | E21B 33/062 |

* cited by examiner

FORGED BOP INTERNAL CAVITY PROFILE FOR WORKOVER RIGS

BACKGROUND

The present invention relates generally to Ram Blow Out Preventers ("BOPs"), and more specifically, to a forged Ram BOP internal cavity profile for lower working pressure ("LWP") workover rigs.

The construction of BOPs for workover rigs is a process of casting. In that process of casting, metal is heated to the melting point and poured into a mold to create the BOP. However, casting components can create flaws or weak areas thereby reducing the overall strength and longevity of the BOP. Whereas, forging a BOP results in a much stronger and longer lasting BOP thereby reducing costs, time to repair or replace the BOP, and thus increasing the overall lifespan and continued operations. Forged BOPs will typically last much longer and not have the flaws of cast BOPs. They will require less maintenance.

Forged BOPs are currently used for large application operations due to the easier access internally to construct. However, forging is much more difficult in smaller BOPs and not currently used to construct workover BOPs for "snubbing" and coiled tubing in lower working pressure (LWP) BOPs. LWP is typically 3K, 5K, a range of 3K to 5K psi, or any value in this range. This is due to the complexity and difficulty of tooling and manufacturing forged smaller, lower pressure workover BOPs. Therefore, those of skill in the art will appreciate the present invention which addresses such a need.

SUMMARY OF THE INVENTION

An objective of the present invention is to provide an improved ram BOP with a forged internal cavity profile for workover rig BOPs.

Still another objective is to provide a unique and simplified design of components within the forged internal cavity that is more easily machined into a relatively small BOP.

Another objective of the present invention is to reduce maintenance and increase operational life of the BOP.

Yet another objective of the present invention is to provide an improved simple light weight reliable BOP design.

Still another objective of the present invention is to provide a design that is interchangeable with most like style BOPs for workover rigs.

Another objective of the present invention is to provide a lightweight and low-profile BOP that is ideal for workover rigs and well servicing rigs with limited height under the floor.

Yet another objective of the present invention is to provide side entry ram access on a forged BOP body for replacement of the rams.

A further objective of the present invention is to provide an internal machined profile for a BOP with a flat lower surface and a raised surface on the lower surface.

Another objective of the present invention is to provide a flat upper surface above the raised surface so that as the ram moves from the open position to the closed position, the ram seals are compressed against the flat upper surface to form a seal.

Another objective is to provide a forged BOP that can replace cast BOP units and use similar components, such as the rams.

Still another objective of the present invention is to provide mud slots machined into the lower surface of the machined internal profile that guide fluids such as mud back into the annulus between pipe and the casing.

These and other objects and advantages may or may not be used depending on the various possible embodiment of the invention.

One general aspect includes a machined internal cavity for a forged BOP. The machined internal cavity also includes a lower surface. The cavity has a flat upper sealing surface above the lower surface. The cavity has a raised landing surface formed on the lower surface. The raised landing surface is positioned to guide the ram to engage the seal with the flat upper sealing surface when the ram is moved to a closed position.

Implementations may include one or more of the following features such as the machined internal cavity having a slot formed into the lower surface of the machined internal cavity. The slot is positioned to guide mud into the throughbore. The machined internal cavity may have a wall with an opening formed in the wall and a ram guide mounted in the opening. The lower surface may be formed so that the seal of the ram is not engaged with the flat upper sealing surface while in an open position. The ram may engage the raised landing surface during movement of the ram from the open position to the closed position such that the seal on the ram engages the flat upper sealing surface in the closed position. A side entry ram access point may be sized to allow the ram to be replaced through the side entry ram access point. The forged BOP is sized for use with a workover rig.

One general aspect includes a machined internal cavity for a forged BOP. The machined internal cavity also includes a wall for the machined internal cavity with a bore in the wall and a ram guide that is insertable into the bore. The ram may be engageable with the ram to guide the ram during opening and closing.

Implementations may include one or more of the following features including the machined internal cavity with a lower surface, a flat upper sealing surface, and a raised landing surface formed on the lower surface to guide the ram to engage the seal with the flat upper sealing surface. The raised landing surface may be positioned with respect to the flat upper sealing surface so that when the ram is moved onto the raised landing surface to a closed position, then the seal on the ram engages the flat upper sealing surface. A side entry ram access point may be sized to allow the ram to be replaced through the side entry ram access point. The raised landing surface may be positioned so that the ram is insertable through the side entry ram access point into the machined internal cavity when the ram is in an open position because the seal on the ram is not engaged with the flat upper sealing surface when the ram is in the open position. The raised landing surface may include a plurality of raised landing surfaces. The flat upper sealing surface may be flat directly above the raised landing surface. The machined internal cavity may include a slot formed in the lower surface. The slot in the lower surface may be positioned to guide mud flow into the throughbore.

One general aspect includes a machined internal cavity for a forged BOP. The machined internal cavity also includes a lower surface of the machined internal cavity and a slot machined into the lower surface. The slot in the lower surface being positioned to guide mud flow into the throughbore.

Implementations may include one or more of the following features such as a flat upper sealing surface, and a raised landing surface formed on the lower surface to guide the ram to engage the seal with the flat upper sealing surface. The raised landing surface may be positioned with respect to the flat upper sealing surface so that when the ram is moved onto the raised landing surface to a closed position, then the seal on the ram engages the flat upper sealing surface. The machined internal cavity may include a side entry ram access point sized to allow the ram to be replaced through the side entry ram access point. The raised landing surface may be positioned so that the ram is replaceable through the side entry ram access point into the machined internal cavity when the ram is in an open position because the seal on the ram is not engaged with the flat upper sealing surface when the ram is in the open position. The machined internal cavity may include an internal cavity wall within the machined internal cavity. The internal cavity wall may be opposite the side entry ram access point machined into the forged BOP. A ram guide may be installed in a counter bore machined in the internal cavity wall. The forged BOP may be sized for use with a workover rig.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages.

BRIEF DESCRIPTION OF THE DRAWINGS

The above general description and the following detailed description and claims are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein:

DETAILED DESCRIPTION

Figure 1A:
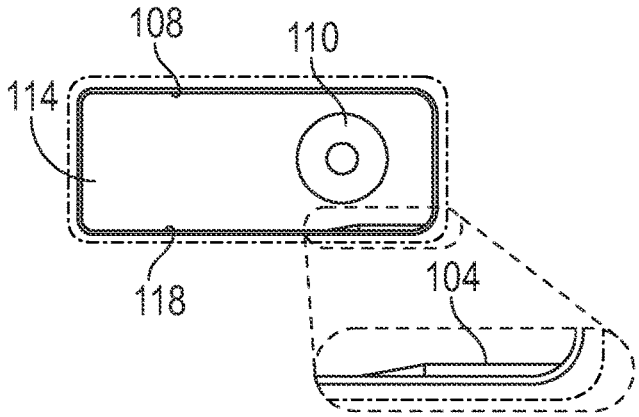
FIGS. 1A-1I are several views of an internal Ram BOP body in accord with one embodiment of the present invention.

Detailed descriptions of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Casting reduces metals to a molten form while forging shapes the metal workpiece while in a solid state.

The present forged or machined BOPs are used in workover rigs for coiled tubing or snubbing. Thus, the preferred definition is specifically a workover rig for coiled tubing or snubbing. A general definition of "workover rig" is a rig for a workover which is typically any operation done on, within, or through the wellbore after the initial completion. A more specific possible definition of a "workover rig" is a mobile self-propelled rig used to perform one or more remedial operations, such as non-limiting examples could include deepening, plugging back, pulling and resetting liners, or other operations on a producing oil or gas well to try to restore or increase the well's production. Accordingly any one, all or several of these definitions may be used individually, separately, or in some combination.

The present invention provides a lower maintenance BOP and increased operational life of the BOP as compared to a cast BOP. The forged BOP is interchangeable with most like style BOPs.

The present invention may include added safety features and certifiable lifting points based on the desired need of the operations. The BOP additionally includes API 16A elastomers for sealing.

The BOP is relatively lightweight and has a low-profile that is ideal for workover rigs and well servicing rigs with limited height under the floor.

The current design uses simplified internal structures that can be more easily manufactured by machining to form a forged BOP. The simplified internal structures perform the required functions without the complexity that some cast BOPs of this size have.

A side entry ram access is provided on the forged BOP body through which rams can be replaced.

In one possible embodiment, the ram block size is 7 1/16" with 3000-5000 psi. Centering ears may be on the blocks to assist in moving pipes to the preventer bore to prevent damage. The temperature rating may be from 30 degrees Fahrenheit to 250 degrees Fahrenheit. Most pipes can be sheared at standard operating pressure with the current invention.

The ram BOP may be, in a preferred embodiment, a 7 1/16 inch 3000-5000 psi design suitable to provide a more cost-effective BOP that meets API requirements and is effective for small workover and well servicing rigs. The current invention provides a more cost-effective BOP. Therefore, the BOP is operable to provide the lowest rated hydraulic operating pressure required for shearing.

In one possible embodiment, an integral booster assembly may be provided to maximize shearing capacity. For example, in one embodiment, a shear ram can shear at standard operating pressure of 1500 psi for most pipe sizes.

The shear blade geometry is operable to centralize tubes in the well bore. Furthermore, the rams are wire line shearing capable.

Looking at FIGS. 1A-1I, several views of an internal Ram BOP body are shown in accord with one embodiment of the present invention. FIG. 1A shows a close up view of raised surface or landing surface 104 formed on a lower surface 118. When the ram is moved to a closed position, the landing surface 104 causes the ram seals to engage a flat surface at the top of the ram cavity.

Figure 1B:
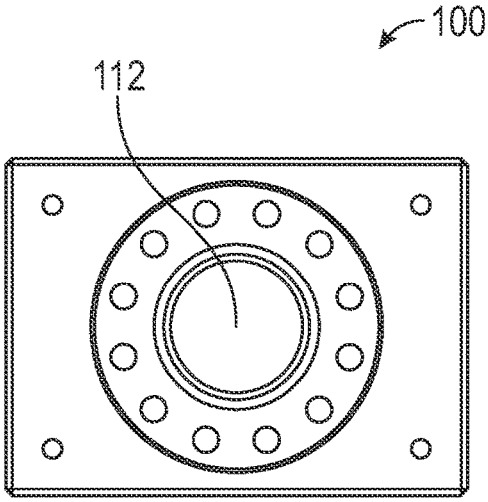
Figure 1C:
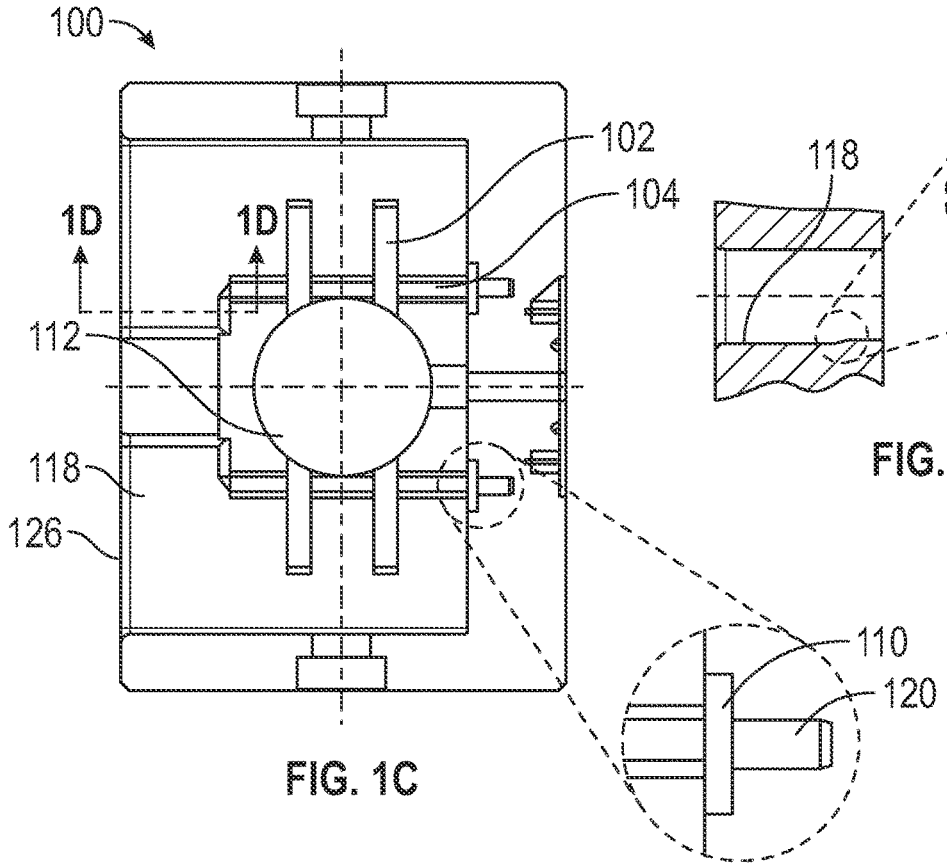
Figure 1D:
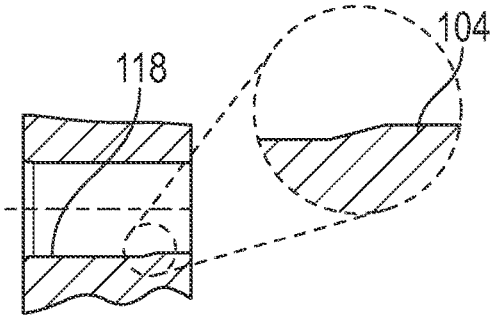
Figure 1E:
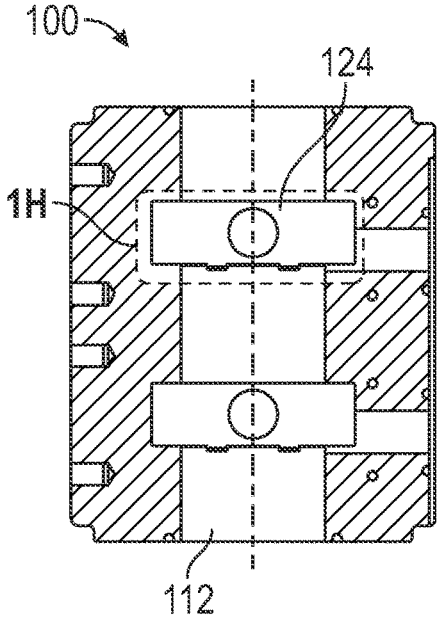
Figure 1F:
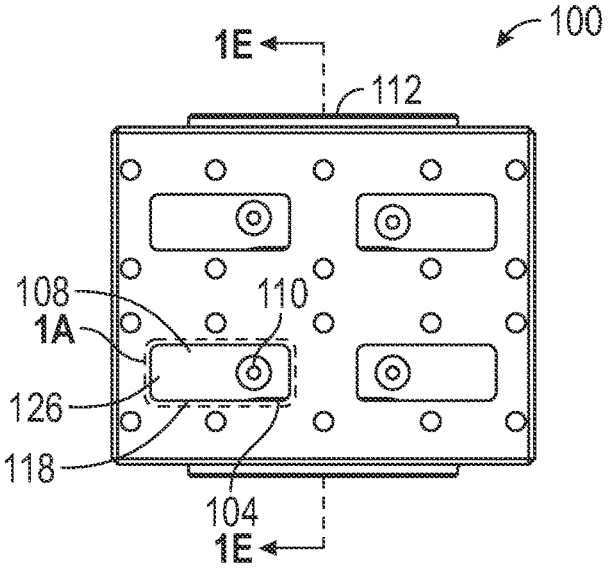
Figure 1G:
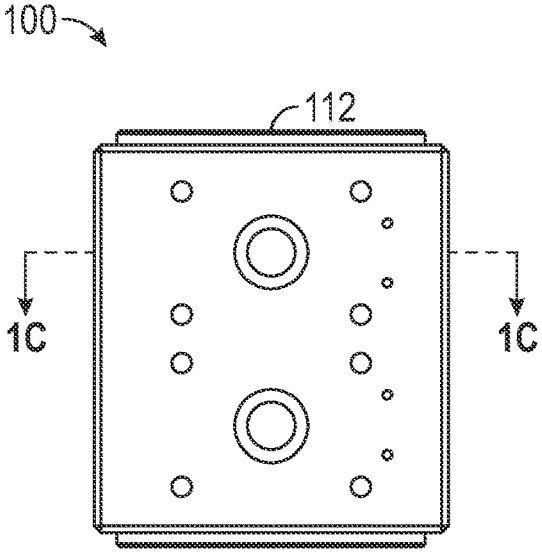
Figure 1H:
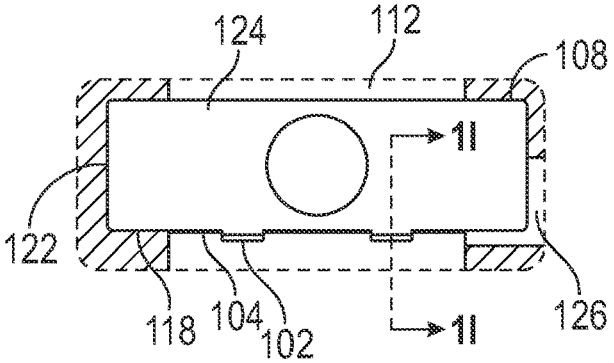
Figure 1I:
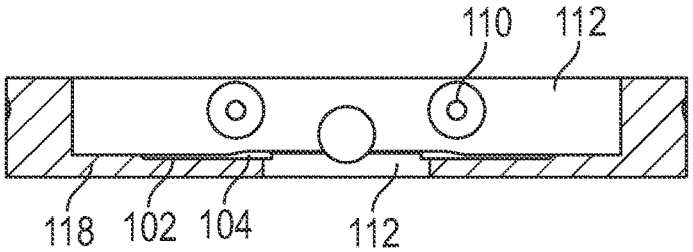

FIG. 1B shows a top view of BOP 100 with throughbore 112 through the center of body 100 whereby pipe can be inserted through the BOP. FIG. 1C shows the top view of internal body cavity 114 with mud slots or slots 102, which are used to drain mud back into the annulus. Thus, the mud slots are positioned to guide the mud back into the throughbore or annulus once a tubular such as coiled tubing is in the throughbore. A close-up of counter bores 120 for ram guides or buttons 110 is also shown on an internal cavity wall. The buttons or guides are positioned to guide the ram during opening and closing. FIG. 1D shows an interior side close up of raised surface 104 relative to lower surface 118. FIG. 1E-1G show different side views of BOP 100. FIG. 1H shows a cross sectional side view of internal cavity 114 with mud slots 102, landing surfaces 104, and upper surface 108. FIG. 1I shows landing surface 104 relative lower surface 118.

Figure 2:
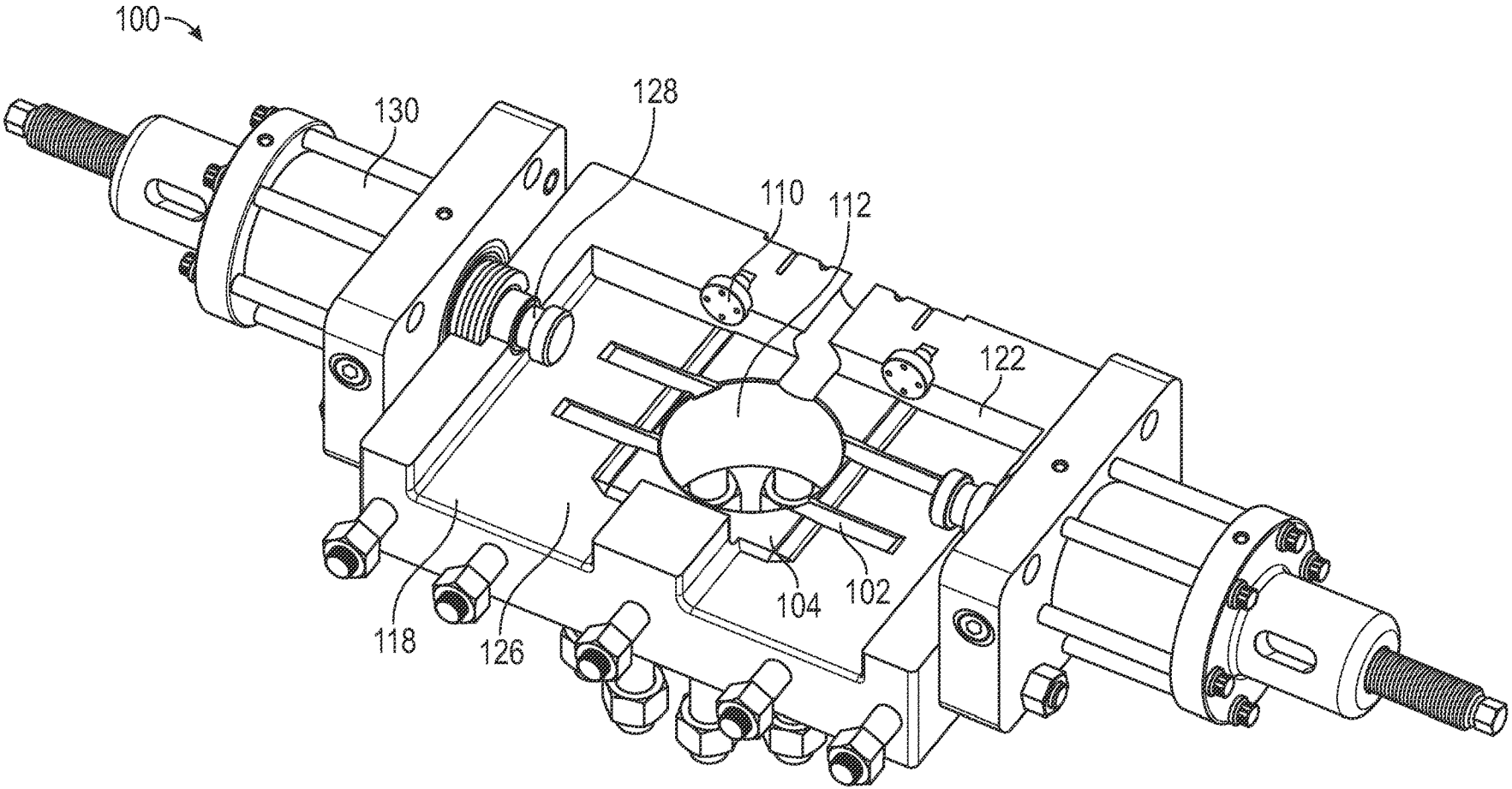
FIG. 2 is a perspective view of the lower portion of an internal Ram BOP in accord with one embodiment of the present invention.
Figure 4:
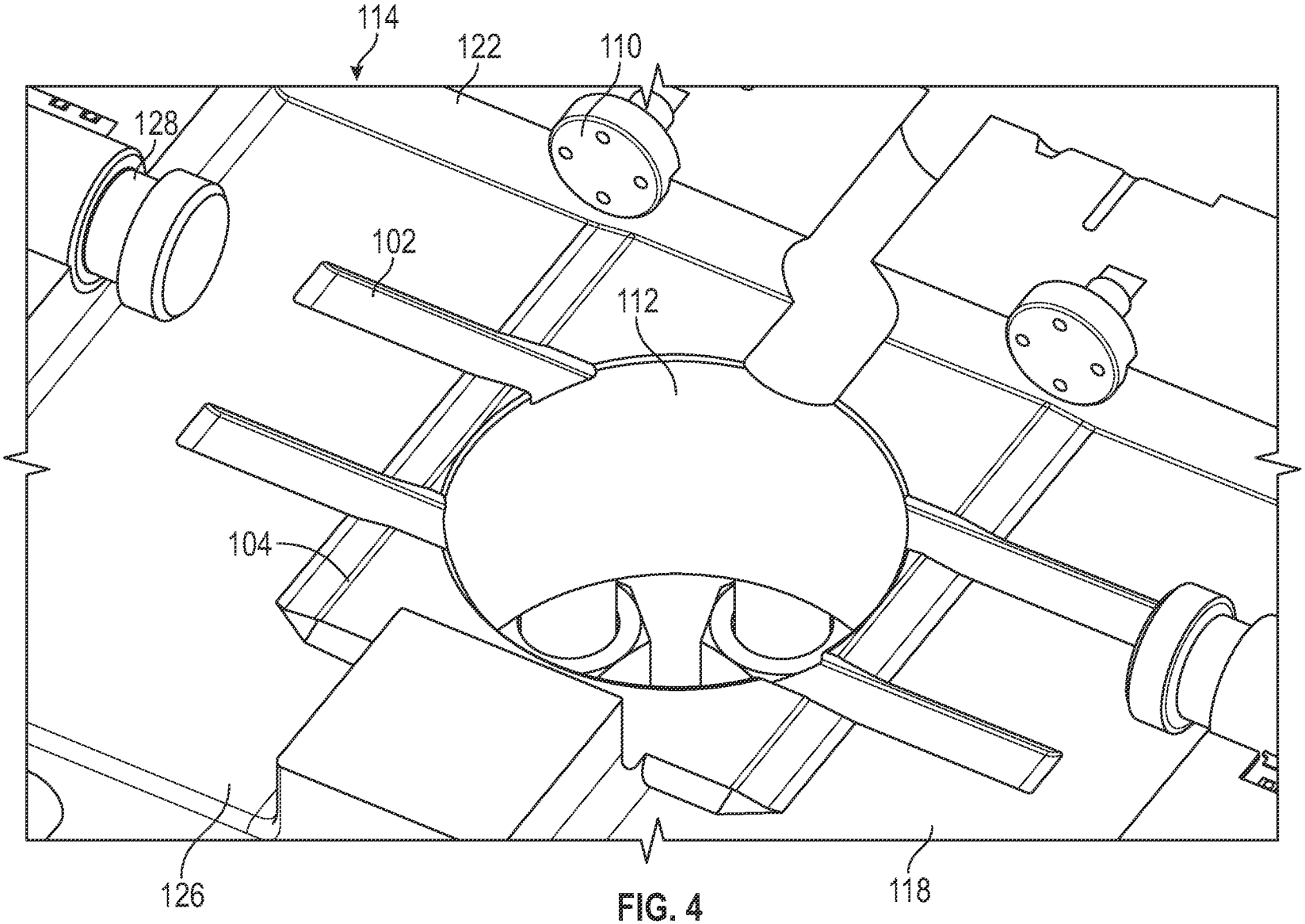
FIG. 4 is a closeup perspective view of the lower portion of an internal Ram BOP in accord with one embodiment of the present invention.

Turning to FIGS. 2 and 4, a perspective and closeup view of the lower portion of an internal Ram BOP 100 is shown in accord with one embodiment of the present invention. For clarity, the rams 106 are not shown in this view. Internal machined cavity 114 is comprised of metal with flat lower surface 118. Mud slots 102 are machined within lower surface 118 to create long narrow channels to allow mud or debris to flow into the bore 112 during operation. In one embodiment, there may be one mud slot or a plurality of mud slots. In a preferred embodiment, at least two mud slots 102 each are on both sides of the bore 112. The mud slots can be machined through the raised or landing surface such that more than one raised surface is then made by the machining of the mud slots. For example, if one mud slot is machined then there may be two raised surfaces on one side of the bore. Therefore, as the number of mud slots is increased, the number of raised surfaces may also increase.

The internal cavity 114 has a side entry ram access opening 126 where the rams may be installed/replaced through the access opening 126. Furthermore, the side entry ram access point 126 allows for access to machine the internal cavity 114.

The cavity 114 extends laterally across to the inner cavity wall 122. The cavity wall 122 has a counter bore 120 in which buttons or ram guides 110 are installed to assist guiding the rams during opening and closing operations. A raised or landing surface 104 is machined or forged in the cavity 114 such that it is a higher level relative lower surface 118. The raised surface 104 is located around the bore 112 such that during closing operations the rams engage the raised surface 104 as they traverse centrally towards the bore 112 to the closed position.

Figure 3:
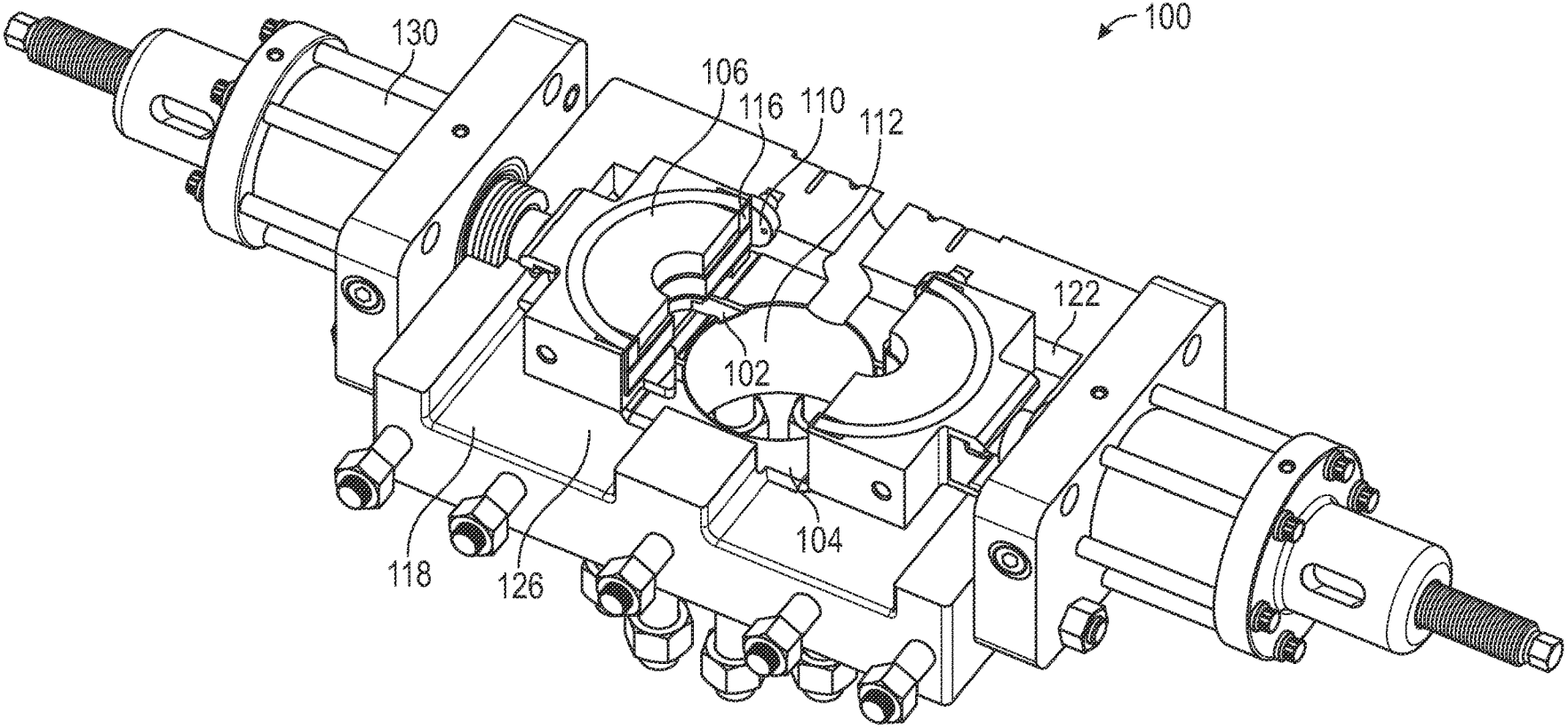
FIG. 3 is a perspective view of the lower portion of an internal Ram BOP with rams attached in accord with one embodiment of the present invention.
Figure 5:
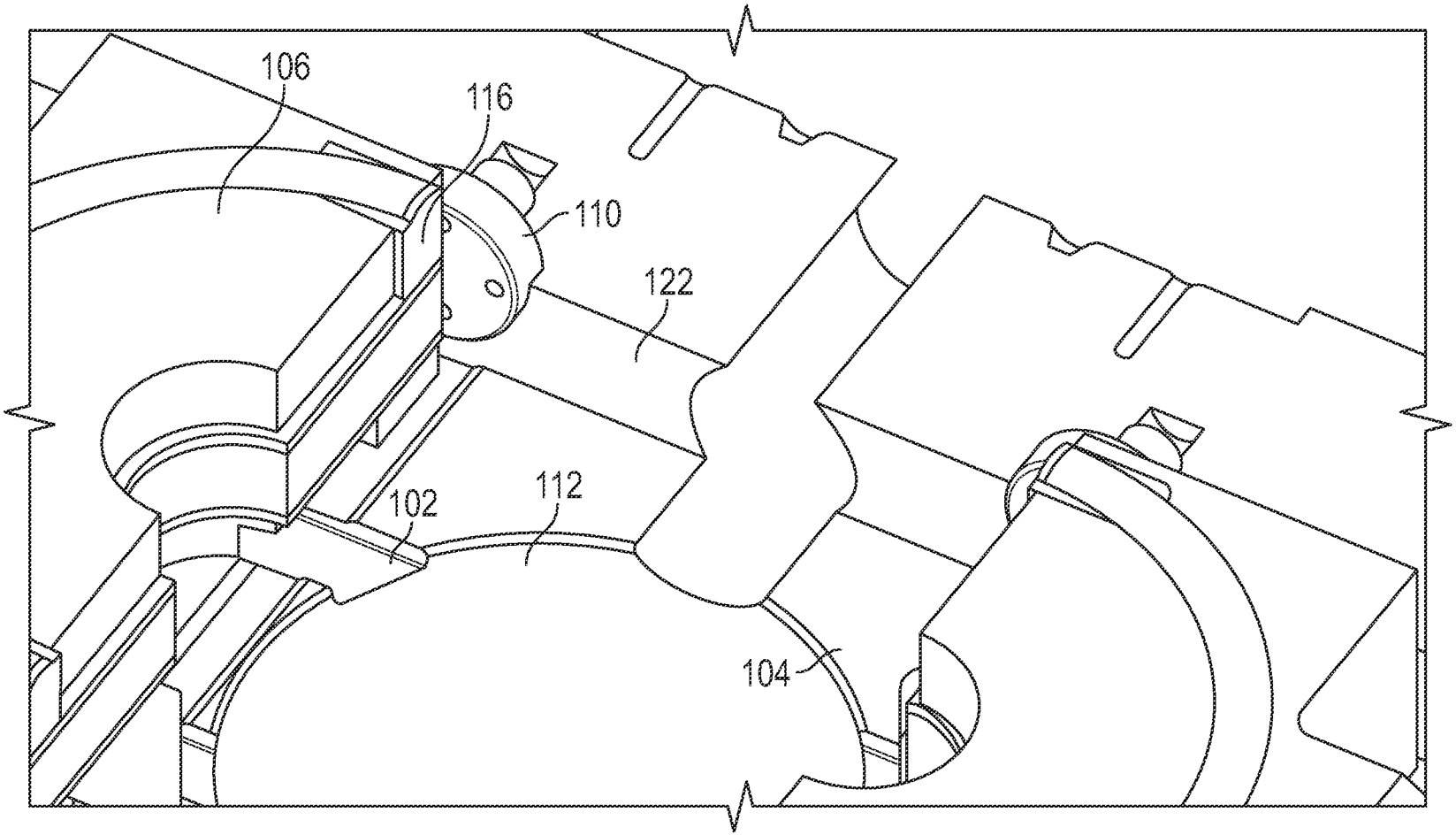
FIG. 5 is a closeup perspective view of the lower portion of an internal Ram BOP with rams attached in accord with one embodiment of the present invention.
Figure 6:
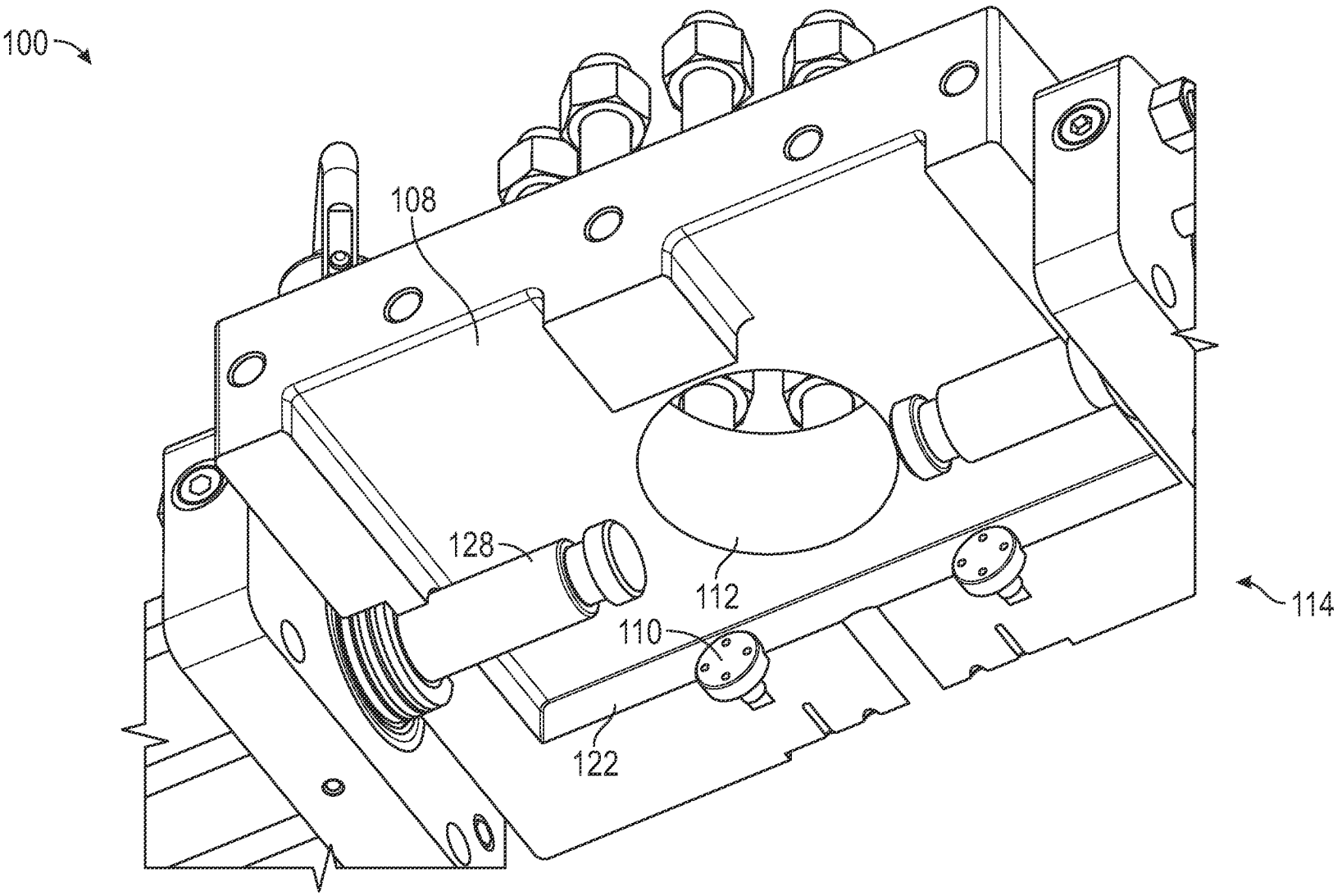
FIG. 6 is a perspective view of the upper portion of an internal Ram BOP in accord with one embodiment of the present invention.
Figure 7:
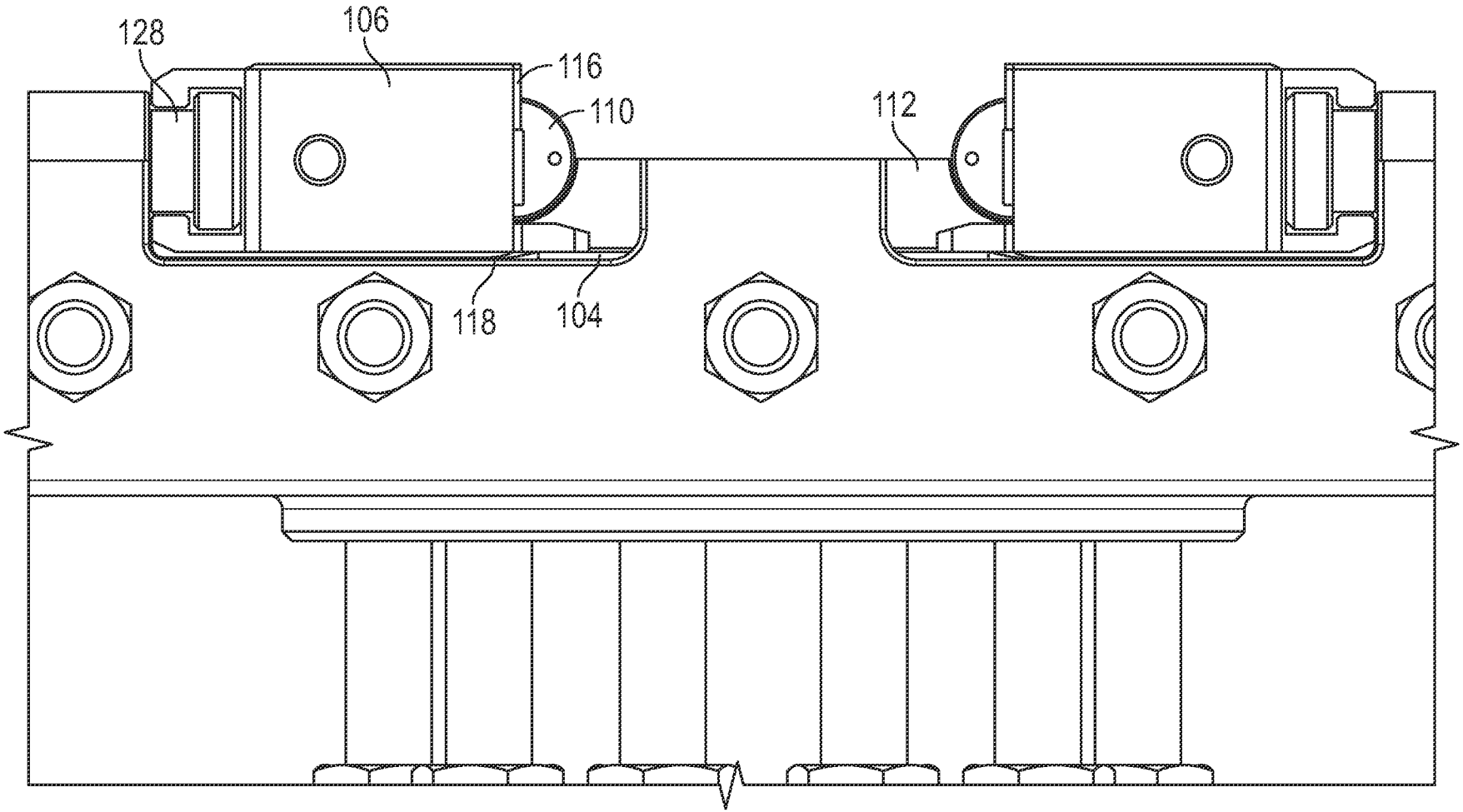
FIG. 7 is side view of the lower portion of an internal Ram BOP with rams attached in accord with one embodiment of the present invention.

In FIGS. 3, 5, and 7, a view of the lower portion of an internal Ram BOP 100 with rams 106 attached are shown in accord with one embodiment of the present invention. The rams may be accessed through side entry access point 126. The forged internal cavity 114 comprises a profile with a lower surface 118 and upper surface 108 (see FIGS. 6 and 9). The lower surface 118 is flat with mud slots 102 machined to allow fluid movement during operation. Debris or fluids can flow into bore 112. Therefore the mud slots are used to allow unimpeded movement of the rams 106 during opening or closing operations. Towards the center of ram cavity 124 is a raised surface 104. Raised surface 104 may be a ramped surface or gradient relative the lower surface 118 surrounding the bore 112. As the ram traverses during closing operations the ram engages the raised surface 104 and is urged upwards towards upper surface 108. The movement of the ram upwards allows for a tighter seal along the upper and lower surfaces. The seals 116 of the rams 106 will therefore stop fluid from escaping the bore when the rams are moved to the closed position. Additionally, the rams 106 will be less likely to encounter any flexing or movement caused by the fluid pressure from the bore so that the rams and ram cavity do not receive damage. This in turns increases the efficiency and life span of the rams and BOP.

The rams are moved to the open or closed position by actuators 130 that urge the ram piston rods 128 in the desired direction. In one possible embodiment, within the ram cavity 124, counter bores or bores 120 (See FIG. 1C) are machined into inner cavity wall 122. Ram guides or buttons 110 are installed in the counter bores 120. The ram guides 110 engage the rams 106 and act as a track or aid to maintain the rams along the proper pathway during opening or closing.

Looking to FIG. 6, a perspective view of the upper portion of an internal Ram BOP is shown in accord with one embodiment of the present invention. Machined or forged internal cavity 114 has an upper and lower surface 108, 118. The upper surface 108 is substantially flat. The ram seals engage upper surface 108 for sealing the ram.

There is a small gap between the rams 106 and upper surface 108 when the rams 106 are in the open position. As the rams 106 are moved into the closed position, the rams 106 engage raised surface 104 and are thereby moved upward to fully engage the upper surface 108 within cavity 114. The ram seals are then compressed between the upper surface 108 and the raised surface 104 creating a fluid seal.

In one possible embodiment, ram guides 110 are installed into counter bores 120 which are machined or forged into inner cavity wall 122. The ram guides 110 may assist the rams 106 in maintaining the required orientation during opening and closing.

Figure 8:
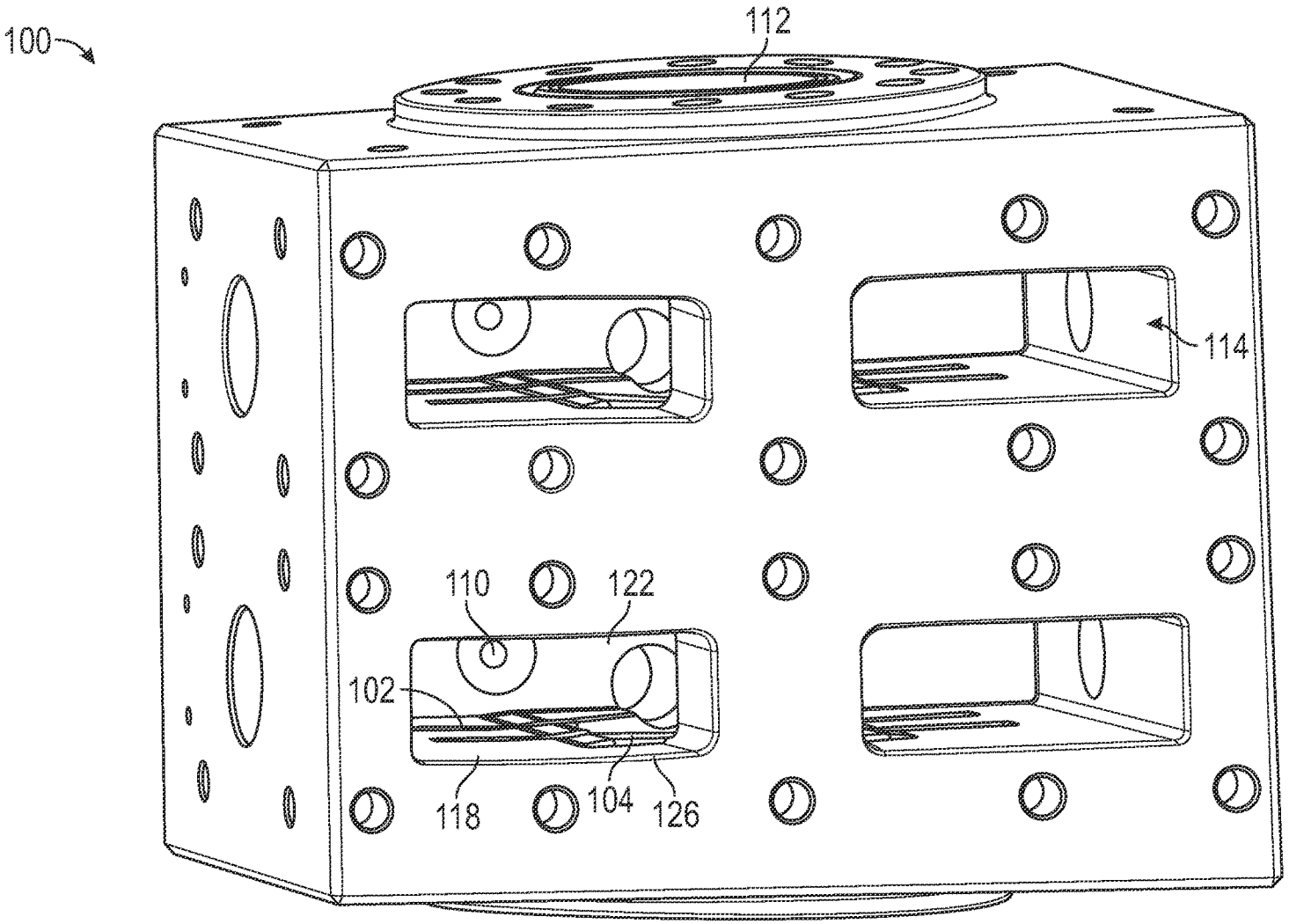
FIG. 8 is a side perspective view of an internal Ram BOP body in accord with one embodiment of the present invention.
Figure 9:
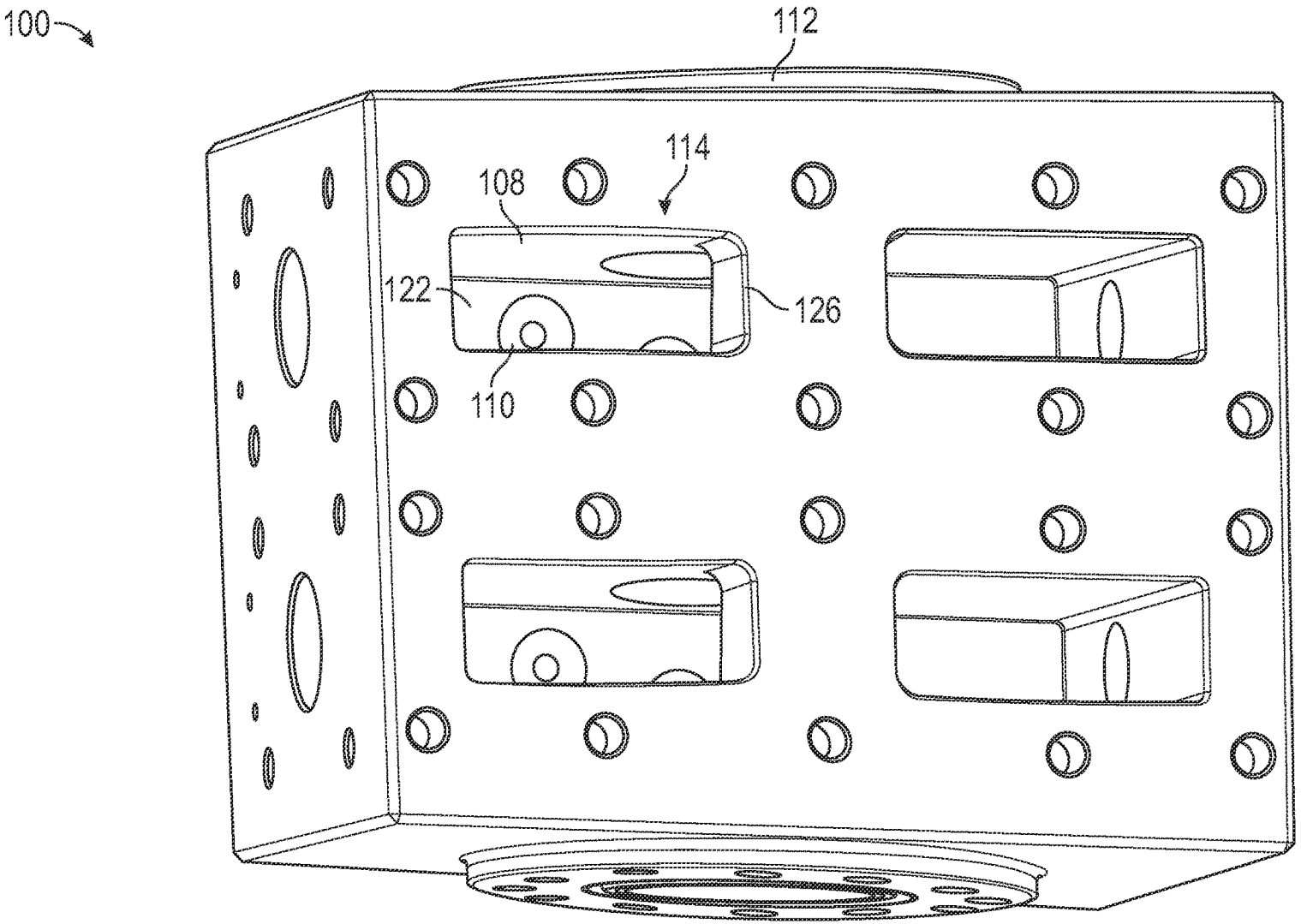
FIG. 9 is a side perspective view of an internal Ram BOP body in accord with one embodiment of the present invention

In FIGS. 8-9, side perspective views of BOP 100 are shown in accord with one embodiment of the present invention. Ram cavity 124 has a side entry access point 126. The rams may be installed or accessed for repairs, maintenance, or the like through said side access point 126. The ram cavity 124 has an upper surface 108 and lower surface 118. In one embodiment, both surfaces may be flat.

As shown, lower surface 118 is flat with at least one mud slot 102 machined into the surface. In a preferred embodiment, two mud slots 102 are present. However, more than two mud slots 102 may be machined into the lower surface 118. Centrally located around the bore 112 are raised surfaces 104 machined into lower surface 118. The raised surface 104 may have a gradient, angled, sloped, curved, or the like leading from the lower surface to the raised surface such that the raised surface is higher or elevated relative lower surface 118. When the rams 106 are moved to the closed position, the rams 106 engage the raised surface 104 and are urged to engage upper surface 108. The ram seals 116 are then energized to seal off fluid movement from the bore 112. Ram guides 110 may be installed within counter bores or bores 120 which may be machined into inner cavity wall 122.

Turning again to FIGS. 1A-I, 8, and 9, various views of a forged internal Ram BOP body for a workover BOP are shown. Forged BOP body 100 is shown with dual BOP chambers or cavities 114, though other embodiments may only include a single BOP chamber. A side entry ram access point 126 is positioned parallel with the center of the bore 112. The present invention is operable with most standard Rams of comparable sized workover Blowout preventers for use in snubbing and/or coiled tubing operations. Another application is for operating conditions where the servicing rigs have limited height under the floor. In a preferred embodiment, the Ram BOP body is designed for 7 1/16" 3k or 5k psi BOP. This simplified internal cavity profile provides for reduced machining requirements using fewer tooling types.

By replacing a cast BOP Body with a forged body, the present invention avoids the many known structural problems inherent in casting, decreases maintenance needs, and extends the recertification and/or remanufacturing cycle.

Looking to FIGS. 2 and 4, a cutout portion of forged BOP body internal cavity 114 is shown with the RAMS 106 removed for clarity. FIG. 3 shows the rams 106 attached to the piston rods 128. Forged RAM BOP body 100 defines a machined internal cavity profile 114. The lower surface 118 of this internal cavity profile 114 comprises at least one mud slot 102 recessed into the lower surface 118 connected with the borehole 112. In a possible embodiment, three mud slots 102 are utilized on each side of the borehole 112. The mud slots may be machined through the raised landing surfaces to create a plurality different landing surfaces, e.g. three landing surfaces. A raised landing surface 104 surrounds the borehole 112, though the raised landing surface 104 may not encompass the entire borehole 112 in other embodiments. In a preferred embodiment, the raised landing surface 104 is approximately 3 mm higher than the lower surface 118 of the internal cavity 124.

Turning to FIG. 6, the upper internal machined body cavity 124 is depicted defining a flat upper sealing surface 108 that is engageable with a seal 116 on the ram 106 when in the fully closed position.

As shown in FIGS. 5 and 7, Ram guides 110 are inserted into machined counter bores 120 on one or more inner cavity walls 122. The Ram guides 110 facilitate the movement of the rams 106 as they engage the raised landing surface 104 on the lower portion of the machined internal ram cavity profile 114 and engage with the flat upper sealing surface 108 to form a seal 116. The raised landing surface 104 is positioned with respect to the flat upper sealing surface 108 so that when the ram 106 is moved onto the raised landing surface 104 that the seal 116 on the ram 106 engages and compresses the seal 116 on the ram 106 to seal with the flat upper sealing surface 108. In one embodiment, flat upper sealing surface 108 is flat over an entirety of the flat upper sealing surface 108. In another embodiment, flat upper sealing surface 108 is flat directly above the raised landing surface 104. The raised landing surface 104 is positioned so that the ram 106 is insertable into a ram cavity 124 more easily because the pair of ram seals 116 are not initially engaged with the flat upper sealing surface 108 but do engage the flat upper sealing surface 108 as the pair of rams 106 are moved toward a closed position of the rams 106.

It will be appreciated that terms such as upper, lower, raised, or the like are used when the BOP is in an operating position, i.e., the BOP is vertically oriented and receives vertically oriented pipe through the throughbore in the BOP.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention. Moreover, the scope of this patent is not limited to its literal terms but instead embraces all equivalents to the claims described.

The invention claimed is:

1. A BOP, comprising:

a forged BOP body, said forged BOP body comprising six planar outer sides that form a box-like structure, said forged BOP body being free of casting defects;

a first planar side of said six planar outer sides comprising a first piston rod opening sized to receive a first piston rod;

a second planar side of said six planar outer sides, said second planar side being on an opposite side of said forged BOP body from said first planar side, said second planar side comprising a second piston rod opening sized to receive a second piston rod;

a third planar side of said six planar outer sides comprising a rectangular opening that extends into a machined internal cavity inside of said forged BOP body, said rectangular opening and said machined internal cavity being sized to receive a first ram with sufficient space within said machined internal cavity to allow connection and disconnection of said first ram with said first piston rod, said first ram comprising a first ram seal;

a fourth planar side of said six planar outer sides, said fourth planar side being on an opposite side of said forged BOP body from said third planar side;

a fifth planar side of said six planar outer sides, said fifth planar side comprising a throughbore sized to receive a pipe through said forged BOP body;

a sixth planar side on an opposite side of said forged BOP body from said fifth planar side, said throughbore extends through said fifth planar side and said sixth planar side;

said machined internal cavity inside of said forged BOP body comprising, a lower surface machined into said forged BOP body, said lower surface being positioned so that said first ram seal of said first ram is not engaged with a flat upper sealing surface while in an open position, said first ram engaging a raised landing surface during movement of said first ram from said open position to a closed position such that said first ram seal on said first ram engages said flat upper sealing surface in said closed position, said flat upper sealing surface being positioned above said lower surface and machined into said forged BOP body; and said raised landing surface being machined into said forged BOP body, said raised landing surface is positioned on a portion of said lower surface, said raised landing surface is positioned to guide said first ram to engage said first ram seal with said flat upper sealing surface when said first ram is moved to said closed position.

2. The BOP of claim 1, further comprising a slot machined into said lower surface of said machined internal cavity, said slot is positioned to direct fluid into said throughbore.

3. The BOP of claim 1, further comprising an internal wall of said machined internal cavity adjacent said fourth planar side, an opening formed in said internal wall, and a guide mounted in said opening.

4. The BOP of claim 1, wherein said forged BOP body comprises a grain flow characteristic of forging.

5. The BOP of claim 1, wherein said BOP comprising a size and pressure rating for use in lower working pressure (LWP) workover rigs.

6. A BOP, comprising:

a forged BOP body, said forged BOP body comprising six planar outer sides that form a box-like structure, said six planar outer sides comprising a forged steel structure, said forged BOP body being free of casting defects;

a first planar side of said six planar outer sides comprising a first piston rod opening sized to receive a first piston rod;

a second planar side of said six planar outer sides, said second planar side being on an opposite side of said forged BOP body from said first planar side, said second planar side comprising a second piston rod opening sized to receive a second piston rod;

a third planar side of said six planar outer sides comprising a rectangular opening that extends into a machined internal cavity inside of said forged BOP body, said rectangular opening and said machined internal cavity being sized to receive a first ram with sufficient space within said machined internal cavity to allow connection and disconnection of said first ram with said first piston rod, said first ram comprising a first ram seal;

a fourth planar side of said six planar outer sides, said fourth planar side being on an opposite side of said forged BOP body from said third planar side;

a fifth planar side of said six planar outer sides, said fifth planar side comprising a throughbore sized to receive a pipe through said forged BOP body;

a sixth planar side on an opposite side of said forged BOP body from said fifth planar side; and said machined internal cavity inside of said forged BOP body comprising, an internal wall for said machined internal cavity, said internal wall being adjacent said fourth planar side, a bore in said internal wall and a ram guide that is insertable into said bore, said ram guide being engageable with said first ram to guide said first ram during opening and closing.

7. The BOP of claim 6, wherein said machined internal cavity further comprises a first ram seal on said first ram, a lower surface, a flat upper sealing surface, and a raised landing surface formed on said lower surface to guide said first ram to engage said first ram seal with said flat upper sealing surface, said raised landing surface is positioned with respect to said flat upper sealing surface so that when said first ram is moved onto said raised landing surface to a closed position, then said first ram seal on said first ram engages said flat upper sealing surface, said lower surface being positioned so that when said first ram is in an open position then said first ram seal on said first ram does not engage said flat upper sealing surface.

8. The BOP of claim 7, comprising a second ram and a second ram seal.

9. The BOP of claim 7, wherein said raised landing surface comprises a plurality of raised landing surfaces.

10. The BOP of claim 7, further comprising a slot machined into said lower surface, said slot in said lower surface being positioned to guide mud flow into said throughbore.

11. The BOP of claim 6, wherein said forged BOP body comprises a grain flow characteristic of forging.

12. The BOP of claim 6, said BOP comprising a weight and volume and pressure rating for use in lower working pressure (LWP) workover rigs.

13. A BOP, comprising:

a forged BOP body that is free of casting defects;

a machined internal cavity inside of said forged BOP body, said machined internal cavity comprising a first ram and a first ram seal on said first ram, said first ram being moveable within said machined internal cavity between an open position and a closed position; and said forged BOP body comprising a throughbore, said throughbore comprising a maximum possible diameter of 7 1/16 inches and said forged BOP body comprising a maximum possible pressure rating of 5000 psi for use on a workover rig.

14. The BOP of claim 13, wherein said forged BOP body comprises six planar outer sides that form a box-like structure;

a first planar side of said six planar outer sides comprising a first piston rod opening sized to receive a first piston rod;

a second planar side of said six planar outer sides, said second planar side being on an opposite side of said forged BOP body from said first planar side, said second planar side comprising a second piston rod opening sized to receive a second piston rod;

a third planar side of said six planar outer sides;

a fourth planar side of said six planar outer sides, said fourth planar side being on an opposite side of said forged BOP body from said third planar side;

a fifth planar side of said six planar outer sides, said fifth planar side defining said throughbore, said throughbore being sized to receive a pipe through said forged BOP body;

a sixth planar side of said six planar sides on an opposite side of said forged BOP body from said fifth planar side; and wherein said machined internal cavity further comprises a flat upper sealing surface, and a raised landing surface formed on a lower surface of said machined internal cavity to guide said first ram to engage said first ram seal with said flat upper sealing surface, said raised landing surface is positioned with respect to said flat upper sealing surface so that when said first ram is moved onto said raised landing surface to a closed position, then said first ram seal on said first ram engages said flat upper sealing surface.

15. The BOP of claim 13, wherein said forged BOP body comprises a grain flow characteristic of forging.

16. The BOP of claim 13, wherein said forged BOP body comprises six planar outer sides;

a first planar side of said six planar outer sides comprising a first piston rod opening sized to receive a first piston rod;

a second planar side of said six planar outer sides, said second planar side being on an opposite side of said forged BOP body from said first planar side, said second planar side comprising a second piston rod opening sized to receive a second piston rod;

a third planar side of said six planar outer sides;

a fourth planar side of said six planar outer sides, said fourth planar side being on an opposite side of said forged BOP body from said third planar side;

a fifth planar side of said six planar outer sides, said fifth planar side comprising said throughbore that is sized to receive a pipe through said forged BOP body;

a sixth planar side on an opposite side of said forged BOP body from said fifth planar side; and wherein said third planar side comprises a rectangular opening that extends into a said machined internal cavity inside of said forged BOP body, said rectangular opening and said machined internal cavity being sized to receive said first ram with sufficient space within said machined internal cavity to allow connection and disconnection of said first ram with said first piston rod.

17. The BOP of claim 16, further comprising an internal cavity wall within said machined internal cavity.

18. The BOP of claim 17, wherein said machined internal cavity further comprising a ram guide installed in a counter bore machined in said internal cavity wall.

19. The BOP of claim 13, wherein said machined internal cavity further comprising a lower surface machined into said machined internal cavity; and a slot machined into said lower surface, said slot in said lower surface being positioned to guide mud flow into said throughbore.

* * * * *